US005639998A

United States Patent [19]

Ricks et al.

[11] Patent Number: 5,639,998

[45] Date of Patent: Jun. 17, 1997

[54] HORN SWITCH JACKET

[75] Inventors: Merle K. Ricks, Layton; Kevin W. Booth, Roy, both of Utah

[73] Assignee: Morton International, Inc., Chicago, Ill.

[21] Appl. No.: 585,269

[22] Filed: Jan. 11, 1996

[51] Int. Cl.[6] ..... H01H 9/00

[52] U.S. Cl. ..... 200/61.54; 280/728.3

[58] Field of Search ..... 200/61.54; 280/728.3

[56] References Cited

U.S. PATENT DOCUMENTS

| | | | |
|---|---|---|---|
| 4,575,117 | 3/1986 | Uchida | 200/61.54 |
| 5,086,785 | 2/1992 | Gentile et al. | 128/782 |
| 5,265,904 | 11/1993 | Shelton et al. | 200/61.54 |
| 5,577,767 | 11/1996 | Nemoto | 200/61.54 |

*Primary Examiner*—Stuart N. Hecker
*Attorney, Agent, or Firm*—George W. Rauchfuss, Jr.; Gerald K. White

[57] ABSTRACT

A horn switch pocket for use with a bend sensor horn switch as part of a horn switch assembly for mounting in a horn switch pocket of an airbag module. The bend sensor horn switch has a variable resistance circuit that is connectable to a horn control circuit and has a plurality of spaced-apart resistive elements. The horn switch jacket substantially encloses the bend sensor horn switch and includes a jacket front cover having a rear inner surface positioned in front of the bend sensor horn switch. A plurality of parallel, spaced-apart, elongated force concentration ribs extend from the rear inner surface with each resistive element positioned behind a force concentration rib. A jacket back cover has a front inner surface positioned behind the bend sensor horn switch. A plurality of parallel spaced-apart elongated support ribs extend from the front inner surface parallel to and offset from the force concentration ribs, so that each resistive element is positioned between two adjacent support ribs, whereby pressure applied to the front cover causes at least one force concentration rib to bend at least one resistive element about two adjacent support ribs. According to another embodiment of the invention, the horn switch assembly includes a membrane horn switch in place of the bend sensor horn switch, and the horn switch jacket simply includes a plurality of spaced-apart cylindrical force concentrators extending from a rear inner surface of a jacket front cover.

18 Claims, 5 Drawing Sheets

HORN SWITCH JACKET

FIELD OF THE INVENTION

The present invention relates to a horn switch assembly and, more particularly, to a horn switch jacket for use with a horn switch assembly adapted for insertion into a horn switch pocket of a driver side airbag module.

BACKGROUND OF THE INVENTION

Driver side airbag modules, which include an airbag cushion and an airbag module cover, are normally positioned within a hub of a steering wheel of a motor vehicle. The hub of the steering wheel also happens to be the same area which conventionally includes a horn switch assembly. Accordingly, the airbag module cover must additionally serve to actuate the horn switch. A horn switch assembly normally includes a horn switch and a backing plate attached to an inner surface of a horn actuation face of the airbag module cover. The horn switch and backing plate are usually attached to the inner surface by ultrasonic welding or heat staking.

Many horn switch assemblies include a membrane horn switch. Membrane switches conventionally comprise two very thin sheets having conductive coatings thereon which are normally separated by thin spacers. Pressure on the switch pushes the conductive surfaces together to close a circuit and actuate the horn. Normally, a plurality of force concentrators are positioned on the inner surface of the horn actuation area of the airbag module cover to transfer driver applied pressure more efficiently to the horn switch.

Some horn switch assemblies include a bend sensor horn switch that includes a bend sensitive variable resistance circuit. The resistance of the variable resistance circuit measurably changes as it is bent and the variable resistance circuit is connectable to a horn control circuit that responds to extremely rapid changes in resistance but not to more gradual changes caused by, for example, temperature variations or close packing of the horn switch within the airbag module. Normally, a plurality of force concentrators are positioned on the inner surface of the horn actuation area of the airbag module cover and a plurality of supports are positioned on the backing plate. The force concentrators and supports are arranged to bend the variable resistance circuit in preferably only one axis or direction. In addition, the force concentrators and supports are provided in the form of elongated ribs for translating a localized driver-applied force over a greater area of the bend sensor.

Mounting the horn switch assembly to the airbag module cover by ultrasonic welding or heat staking has been found to be a time consuming assembly process that increases the cost of manufacturing the airbag module. In addition, the horn switch is sometimes damaged by heat staking, requiring the replacement of the horn switch and airbag module cover. A horn switch assembly welded to the airbag module cover requires replacing the entire airbag module cover when replacing damaged or defective horn switches. Furthermore, heat staking puts constraints on the design, material and manufacture of the airbag module cover.

One alternative to mounting the horn switch assembly by heat staking or welding is to provide a horn switch pocket in the airbag module for receiving and holding the horn switch assembly against the inner surface of the horn actuation area of the airbag module cover. An example of such a horn switch pocket is shown and described in co-pending application Ser. No. 08/587,855 filed Jan. 11, 1996 (Attorney's Docket Number 30932100.173).

There is, therefore, a need for a horn switch assembly that is adapted to be mounted in a horn switch pocket of an airbag module. There is a further need for the horn switch assembly to be provided in embodiments incorporating a membrane horn switch and a bend sensor horn switch.

SUMMARY OF THE INVENTION

An object, therefore, of the present invention is to provide a horn switch assembly that meets one or more of the above needs. In carrying out this invention there is provided a horn switch jacket for use with a horn switch as part of a horn switch assembly for insertion into a horn switch pocket adjacent an airbag module cover, whereby the horn switch assembly does not have to be heat staked or welded to the airbag module cover. The horn switch jacket comprises a jacket front cover adapted to be positioned in front of the horn switch, and a jacket back cover adapted to be positioned behind the horn switch. A hinge portion connects a first edge of the jacket front cover to a first edge of the jacket back cover, and securing means is provided for securing the jacket back cover to the jacket front cover with the horn switch held therebetween.

According to one aspect of the present invention, a plurality of spaced-apart force concentrators extend rearwardly from a rear inner surface of the jacket front cover, and the horn switch jacket is adapted for use with a horn switch comprising a membrane horn switch. According to another aspect of the present invention, a plurality of spaced-apart force concentrators extend rearwardly from a rear inner surface of the jacket front cover, a plurality of supports extend forwardly from a front inner surface of the jacket back cover and the horn switch jacket is adapted for use with a bend sensor horn switch having a plurality of spaced-apart resistive elements.

The invention together with further objects, features, advantages and aspects thereof, will be more clearly understood from the following description taken in connection with the accompanying drawings.

BRIEF DESCRIPTION OF THE DRAWINGS

The same reference numerals refer to the same elements throughout the various figures.

DETAILED DESCRIPTION OF THE INVENTION

The present invention is directed to a horn switch jacket for use with a horn switch as part of a horn switch assembly for insertion into a horn switch pocket adjacent an airbag module cover. It is important to note that a horn switch jacket according to the present invention can be adapted for use with different types of horn switches, and can include other modifications without departing from the true spirit and scope of the present invention.

Figure 2:
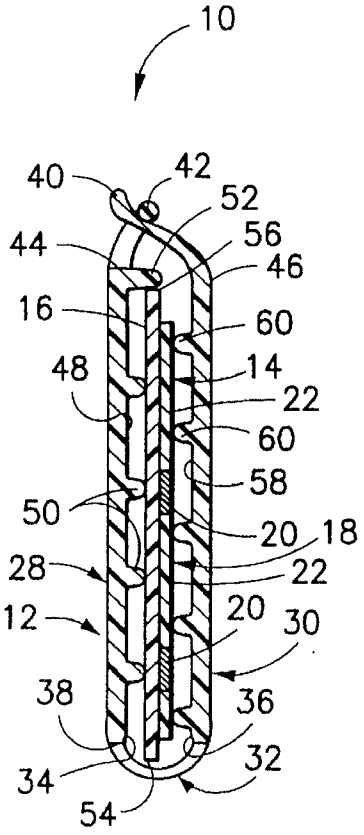
FIG. 2 is a cross sectional view of the horn switch assembly taken along the line 2—2 of FIG. 1.
Figure 1:
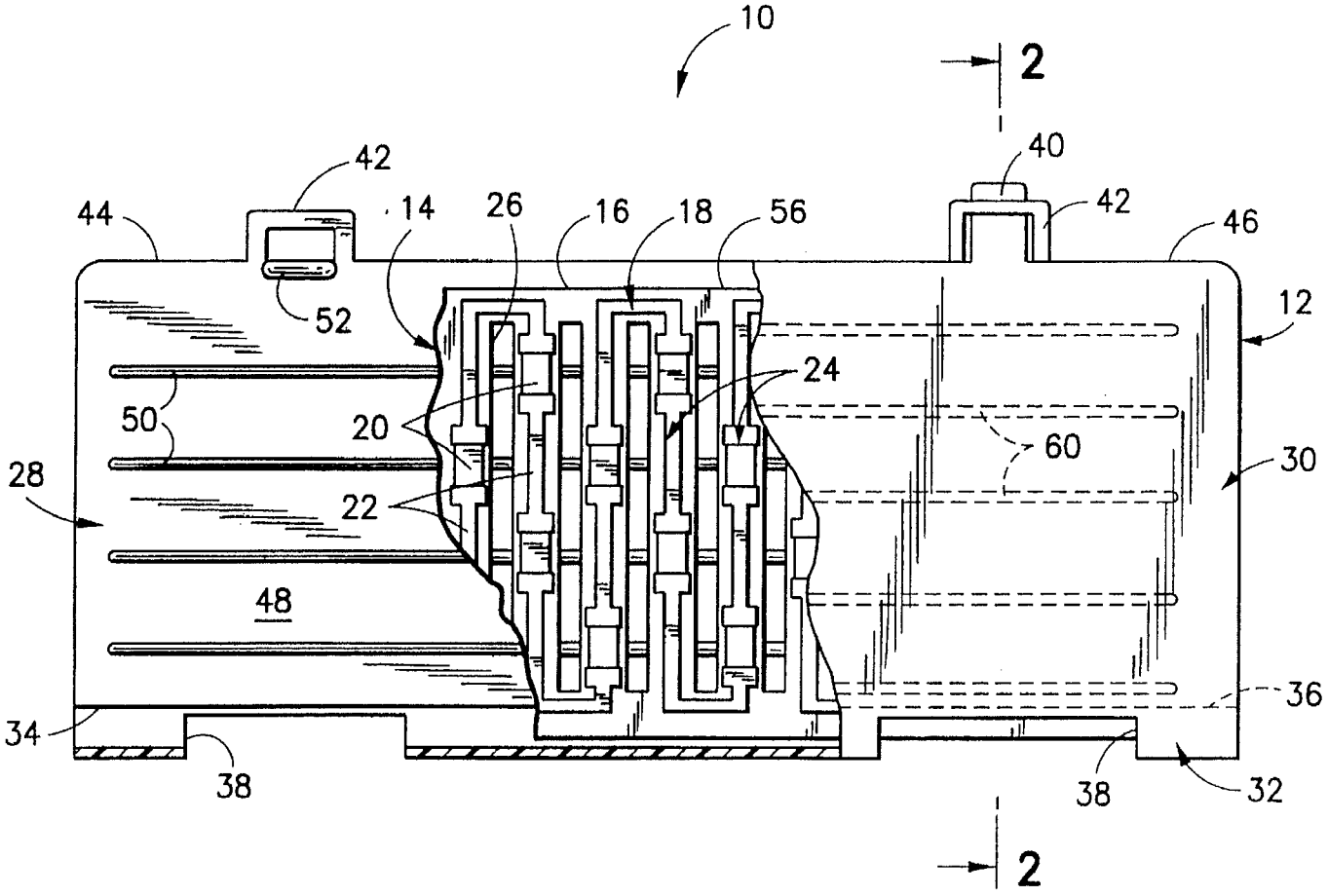
FIG. 1 is a rear elevation view, partially cut away, of a horn switch assembly according to the present invention.

Referring first to FIGS. 1 through 2, one possible embodiment of a horn switch jacket 12 according to the present invention for use with a bend sensor horn switch 14 as part of a horn switch assembly 10 is shown. The horn switch assembly 10 is for use in a driver side airbag module which is mounted in the hub of an automobile steering wheel. Driver side airbag modules are generally known in the art and, accordingly, are not described in detail as they do not in themselves constitute features of the present invention. The horn switch assembly 10 according to the present invention is adapted to be mounted within an airbag module simply by being inserted into a horn switch pocket attached to an airbag cushion or to a cushion strap of the airbag module. A horn switch pocket containing the horn switch assembly 10 is positioned tightly between a folded airbag cushion and a horn actuation face of an airbag module cover of the airbag module. The horn switch assembly 10 can then be actuated by a driver pushing on the horn actuation face of the airbag module cover.

The bend sensor horn switch 14 includes a flexible substrate 16 and a variable resistance circuit 18 adhered to the flexible substrate. In FIG. 2, the flexible substrate 16 and variable resistance circuit 18 are shown with a thickness that is substantially disproportionate to their true thickness solely to facilitate illustration. The variable resistance circuit 18 basically comprises a flexible potentiometer which is known in the art. An example of a flexible potentiometer is shown and described in U.S. Pat. No. 5,309,135. The variable resistance circuit 18 has a plurality of spaced-apart resistive elements 20 connected by a plurality of conductive strips 22, and the variable resistance circuit is arranged in a plurality of parallel spaced-apart columns 24. The conductive strips 22 comprise a flexible electrical conductive coating that may be applied to the flexible substrate 16 by any suitable means such as by screening conductive ink thereon, for example.

The resistance of the variable resistance circuit 18 changes as the resistive elements 20 are bent. The resistive elements 20 generally comprise a flexible electrical conductive coating that may also be applied to the flexible substrate 16 by any suitable means such as by screening conductive ink thereon. The resistive elements 20 can contain flexible carbon fibers which separate when the resistive elements 20 are bent in a particular direction. As the carbon fibers separate the resistance of the resistive elements 20 increase, changing the resistance of the variable resistance circuit 18 which is connectable to a remote power supply and to a remote horn control circuit utilized to actuate a remote horn.

The remote horn control circuit closes a circuit between the remote power supply and the remote horn when the driver presses against the front outer face of the airbag module cover with at least a threshold amount of force. The threshold amount of force causes the resistive elements 20 to bend and the resistance of the variable resistance circuit 18 to measurably change. A preferred horn control circuit only responds to rapid changes in the resistance of the variable resistance circuit 18 but not to more gradual changes. Normally, thermal expansion or contraction of the airbag module cover, curvature of the cover or close packing of the horn switch assembly 10 and a folded airbag cushion normally contained in an airbag module assembly may bend the resistive elements 20 and change the resistance of the variable resistance circuit 18 enough to inadvertently actuate the horn. However, the rate of change of resistance is very slow. A preferred horn control circuit prevents inadvertent actuation of the horn since only a force applied by a driver pressing on the airbag module cover will have the required rate of change of force or resistance necessary to actuate the horn. Those skilled in the art will appreciate that a variety of circuits may be employed to carry out the functions of a preferred horn control circuit. The horn control circuit may include a microprocessor that can be programmed to meet the specific requirements of an automotive manufacturer.

The flexible substrate 16 comprises electrical insulating material such as a suitable plastic material, for example MYLAR polyester or polyethylene with a thickness of approximately 0.10 millimeters. As shown in FIG. 1, the flexible substrate 16 also includes slots 26 located between the columns 24 of the variable resistance circuit 18. The slots 26 allow the resistive elements 20 in each column 24 to bend more easily in substantially one direction and, in the alternative, the flexible substrate 16 could simply include slits located on opposites sides of each column 24 of the variable resistance circuit 18.

The horn switch jacket 12 is folded, like a book cover, over the bend sensor horn switch 14 to substantially enclose the bend sensor horn switch 14 and includes a jacket front cover 28, a jacket back cover 30 and a hinge portion 32 that are unitary. The horn switch jacket 12 is made from a suitable resilient material such as a thermoplastic resin like polyurethane, for example. The hinge portion 32 connects a first edge 34 of the jacket front cover 28 to a first edge 36 of the jacket back cover 30 and allows the horn switch jacket 12 to be opened and closed like a book. As shown, the hinge portion 32 has a smaller thickness than the jacket front cover 28 or the jacket back cover 30 which allows the hinge portion to be more flexible. The hinge portion 32 may also include cut-outs 38 which allow further flexibility. Securing means secures the horn switch jacket 12 in a closed position around the bend sensor horn switch 14 and the securing means comprises two tabs 40 and two tab receptors 42. The two tab receptors 42 extend from a second edge 44 of the jacket front cover 28 and have openings for receiving and retaining the two tabs 40 that extend from a second edge 46 of the jacket back cover 30 to secure the horn switch jacket 12 in a closed position and hold the bend sensor horn switch 14 between the jacket front cover and the jacket back cover. Alternatively, the securing means could comprise more than two tabs and tab receptors.

The jacket front cover 28, which substantially covers the bend sensor horn switch 14, has a rear inner surface 48 positioned in front of the bend sensor horn switch 24. A plurality of spaced-apart force concentrators in the form of parallel, spaced-apart, elongated force concentration ribs 50 extend rearwardly from, and are preferably unitary with, the rear inner surface 48 of the jacket front cover 28. The force concentration ribs 50 are generally perpendicular to the columns 24 of the variable resistance circuit 18 and are arranged on the rear inner surface 48 so that each resistive element 20 is positioned behind a force concentration rib. Alignment retaining means comprising two bumpers 52 extend rearwardly from the rear inner surface 48 of the jacket front cover 28. A first edge 54 of the bend sensor horn switch 14 butts against the hinge portion 32 and a second edge 56 of the bend sensor horn switch 14 butts against the two bumpers 52 to ensure that the resistive elements 20 of the bend sensor horn switch 14 stay aligned with the force concentration ribs 50. Alternatively, the alignment retaining means could be provided in another form.

The jacket back cover 30, which also substantially covers the bend sensor horn switch 14, has a front inner surface 58 positioned behind the bend sensor horn switch 14. A plurality of spaced-apart supports in the form of parallel spaced-apart elongated support ribs 60 extend forwardly from, and are preferably unitary with, the front inner surface 58. The support ribs 60 are arranged so that the support ribs are generally parallel to and offset from the force concentration ribs 50 when the horn switch jacket 12 is closed. The support ribs 60 are also generally perpendicular to the bend sensor columns 24 so that each conductive strip 22 is positioned in front of a support rib and each resistive element 20 is positioned between two adjacent support ribs 60. Pressure applied to the jacket front cover 28 will cause at least one force concentration rib 50 to bend at least one resistive element 20 about two adjacent support ribs 60.

The force concentration ribs 50 and support ribs 60, in combination, assure that the resistive elements 20 of the bend sensor horn switch 14 are bent in substantially one axis or direction. In addition, the force concentration ribs 50 distribute a localized force applied to the jacket front cover 28 to more than one resistive element 20. The present invention, also provides a horn switch assembly 10 that is self-contained and can be easily inserted into a horn switch pocket of an airbag module as opposed to being heat staked or welded to an airbag module cover. The horn switch assembly 10 can, therefore, be easily assembled to the airbag module and easily removed for servicing or replacement.

The bend sensor horn switch 14, jacket front cover 28 and jacket back cover 30 as shown in FIG. 1 are generally rectangular but can be contoured to match the shape of an airbag module cover by using a thermal forming operation so that the bend sensor horn switch, jacket front cover and jacket back cover could also be square or circular, for example.

Figure 4:
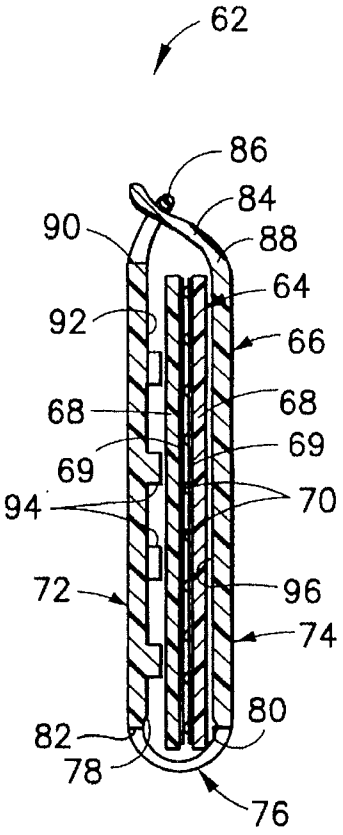
FIG. 4 is a cross sectional view of the horn switch assembly taken along the line 4—4 of FIG. 3.
Figure 3:
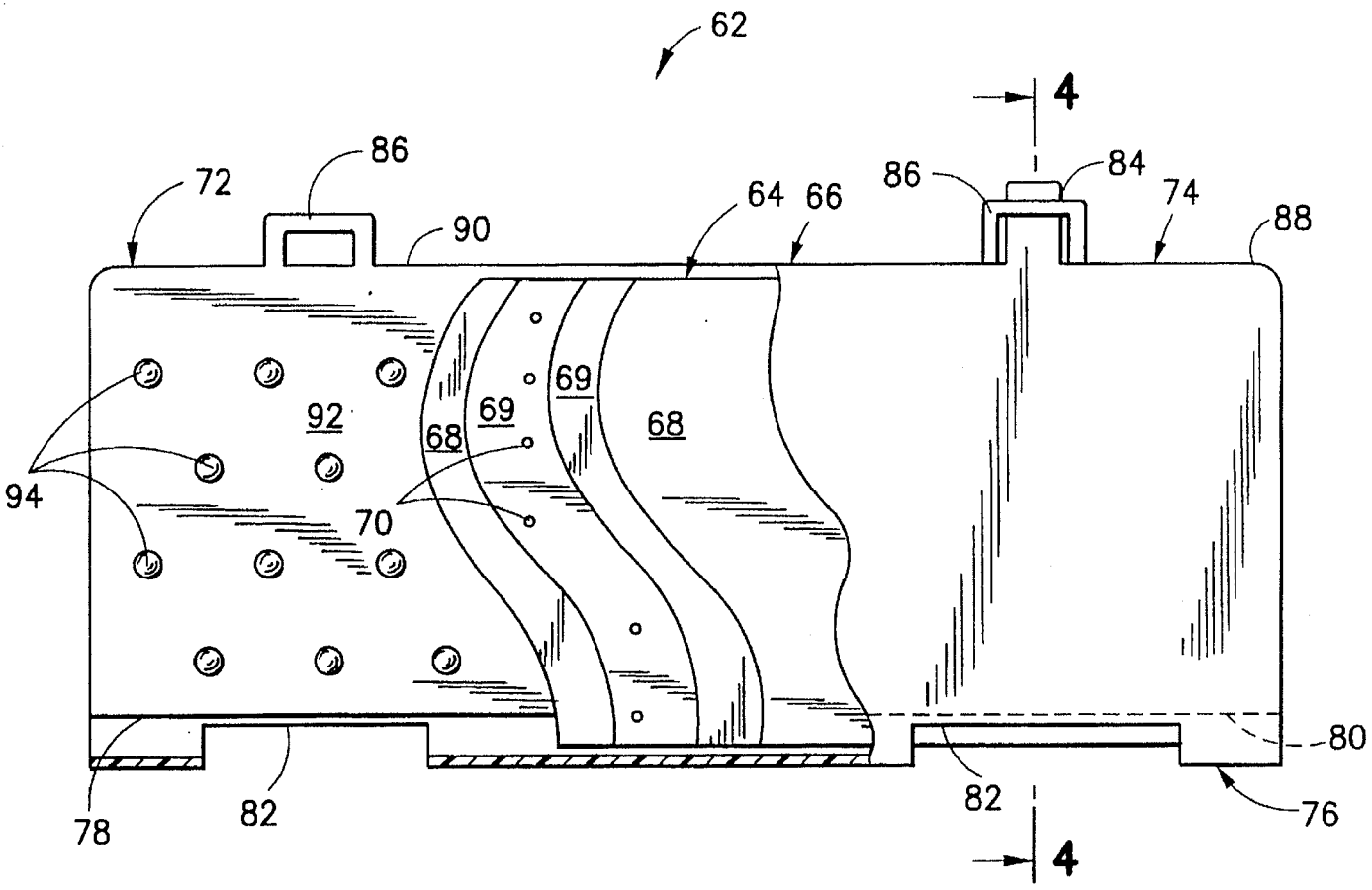
FIG. 3 is a rear elevation view, partially cut away, of another horn switch assembly according to the present invention.

Referring to FIGS. 3 and 4, another possible embodiment of a horn switch jacket 66 according to the present invention for use with a membrane horn switch 64 as part of a horn switch assembly 62 is shown. A membrane horn switch 64 is known to those skilled in the art and an example of a membrane horn switch is shown and described in U.S. Pat. No. 5,369,232. Generally, the membrane horn switch 64 comprises two very thin sheets of flexible substrate 68 having conductive coatings 69 thereon which are separated by thin spacers 70. Pressure on the membrane horn switch 64 pushes the conductive coatings 69 together to close a horn control circuit that the membrane horn switch is connectable to in order to actuate a remote horn.

The horn switch jacket 66 folds over and substantially encloses the membrane horn switch 64 and includes a jacket front cover 72, a jacket back cover 74 and a hinge portion 76 that are unitary. The hinge portion 76 connects a first edge 78 of the jacket front cover 72 to a first edge 80 of the jacket back cover 74 and allows the horn switch jacket 66 to be opened and closed like a book. As shown the hinge portion 76 has a smaller thickness than the jacket front cover 72 or the jacket back cover 74, and the smaller thickness allows the hinge portion to be more flexible. In addition, the hinge portion 76 can include cutouts 82 which allow further flexibility. Securing means for securing the horn switch jacket 66 in a closed position comprises two tabs 84 and two tab receptors 86. The two tab receptors 86 extending from a second edge 90 of the jacket front cover 72 and have openings for receiving and catching the two tabs 84 that extend from a second edge 88 of the jacket back cover 74 to secure the horn switch jacket 66 in a closed position and hold the membrane horn switch 64 between the jacket front cover and the jacket back cover.

The jacket front cover 72 has a rear inner surface 92 positioned in front of the membrane horn switch 64. A plurality of spaced-apart force concentrators in the form of spaced-apart, cylindrical force concentrators 94 extend rearwardly from, and are preferably unitary with, the rear inner surface 92. Any force applied to the jacket front cover 72 is translated into a point force by the force concentrators 94, which may alternatively be provided in non-cylindrical shapes such as square or elongated, for example. The jacket back cover 74 has a front inner surface 96 positioned behind the membrane horn switch 64. Pressure applied to the jacket front cover 72 will cause the membrane horn switch 64 to be squeezed between at least one force concentrator 94 and the front inner surface 96 of the jacket back cover 74 to push the conductive coatings 69 together to close a horn control circuit and actuate a remote horn.

Figure 6:
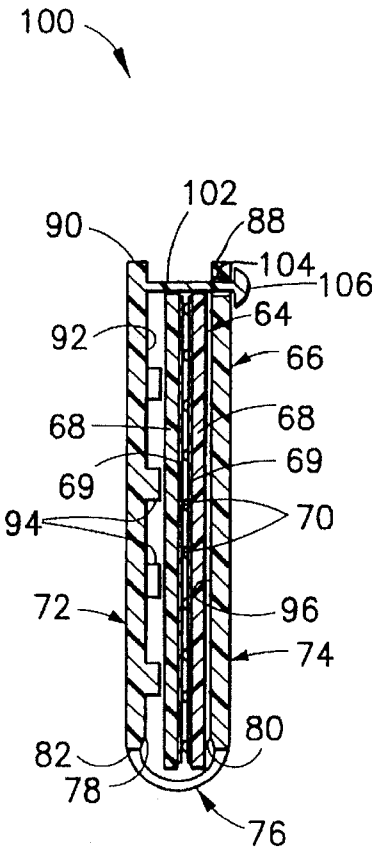
FIG. 6 is a cross sectional view of the horn switch assembly taken along the line 6—6 of FIG. 5.
Figure 5:
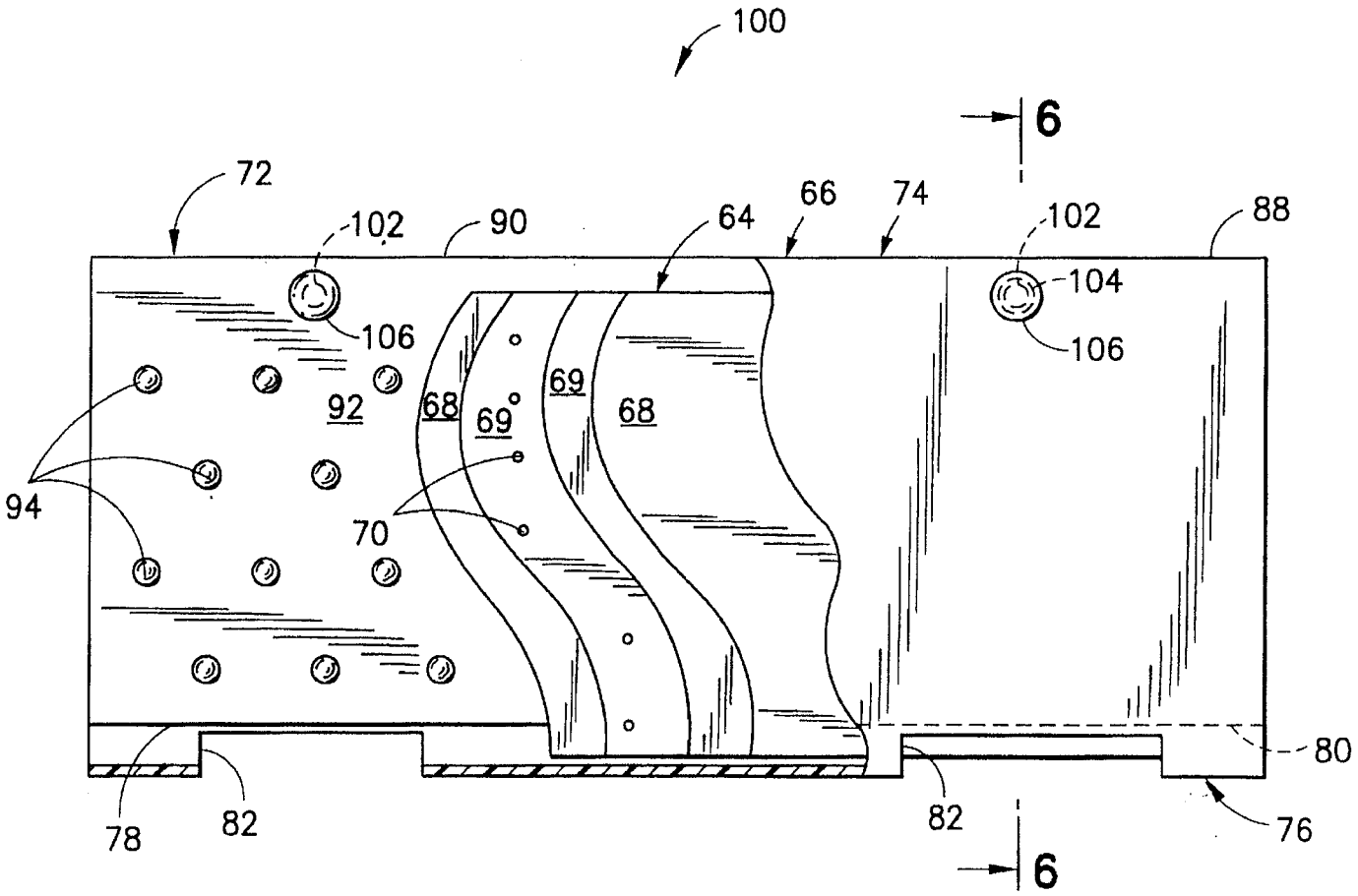
FIG. 5 is a rear elevation view, partially cut away, of an additional horn switch assembly according to the present invention.

FIGS. 5 through 10 show horn switch jackets according to the present invention having examples of different securing means. Referring to FIGS. 5 and 6, an additional horn switch assembly 100 according to the present invention is shown. The horn switch assembly 100 is similar to the horn switch assembly 62 of FIGS. 3 and 4. In place of the two tabs 84 and two tab receptors 86 of the horn switch assembly 62 of FIGS. 3 and 4, two posts 102 extend rearwardly from the rear inner surface 92 of the jacket front cover 72 and extend through two holes 104 defined by the jacket back cover 74. The posts 102 are located adjacent the second edge 90 of the jacket front cover 72 and the holes 104 are located adjacent the second edge 88 of the jacket back cover 74. The posts 102 have heads 106 which snap through the holes 104 and extend over the jacket back cover 74 adjacent the holes to secure the jacket back cover to the jacket front cover 74. The horn switch assembly 10 of FIGS. 1 and 2 could also alternatively have posts and holes for securing the jacket front cover to the jacket back cover in place of tabs and tab receptors.

Figure 8:
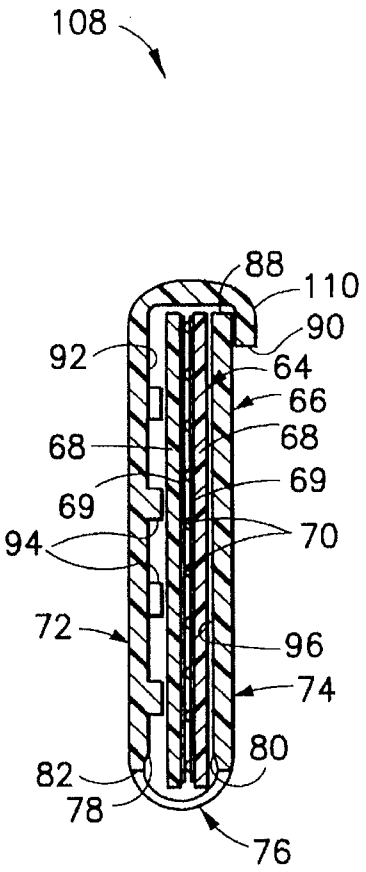
FIG. 8 is a cross sectional view of the horn switch assembly taken along the line 8—8 of FIG. 7.
Figure 7:
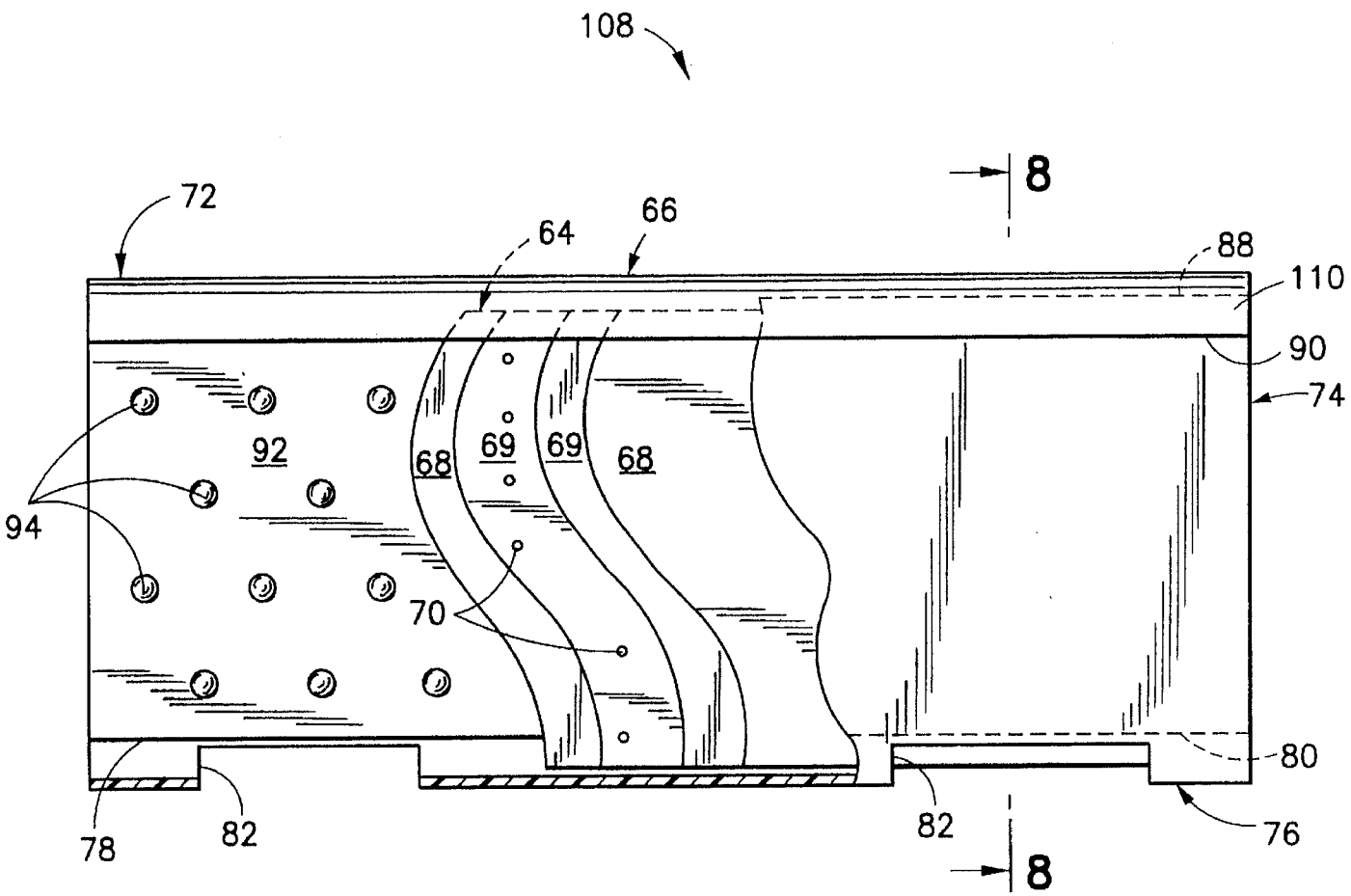
FIG. 7 is a rear elevation view, partially cut away, of a further horn switch assembly according to the present invention.

Referring to FIGS. 7 and 8, an additional horn switch assembly 108 according to the present invention is shown. The horn switch assembly 108 is similar to the horn switch assembly 62 of FIGS. 3 and 4. In place of the two tabs 84 and two tab receptors 86 of the horn switch 62 assembly of FIGS. 3 and 4 however, the second edge 90 of the jacket front cover 72 is curled over rearwardly to form a u-shaped lip 110 that catches or engages the second edge 88 of the jacket back cover 74 and secures the jacket back cover to the jacket front cover. The horn switch assembly 10 of FIGS. 1 and 2 could also alternatively have a lip for securing the jacket front cover to the jacket back cover in place of the tabs and tab receptors.

Figure 10:
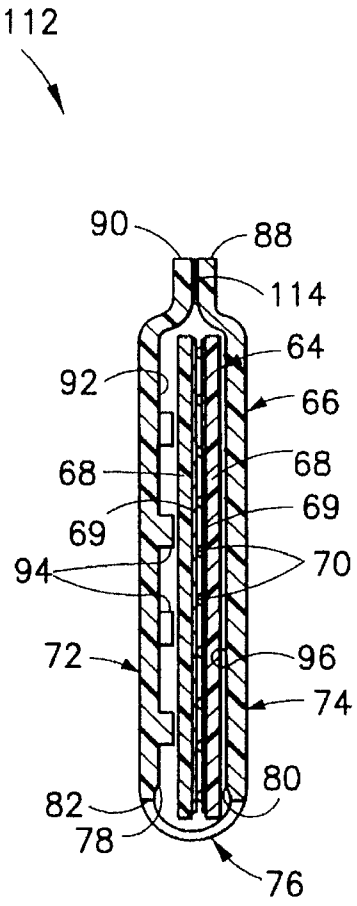
FIG. 10 is a cross sectional view of the horn switch assembly taken along the line 10—10 of FIG. 9.
Figure 9:
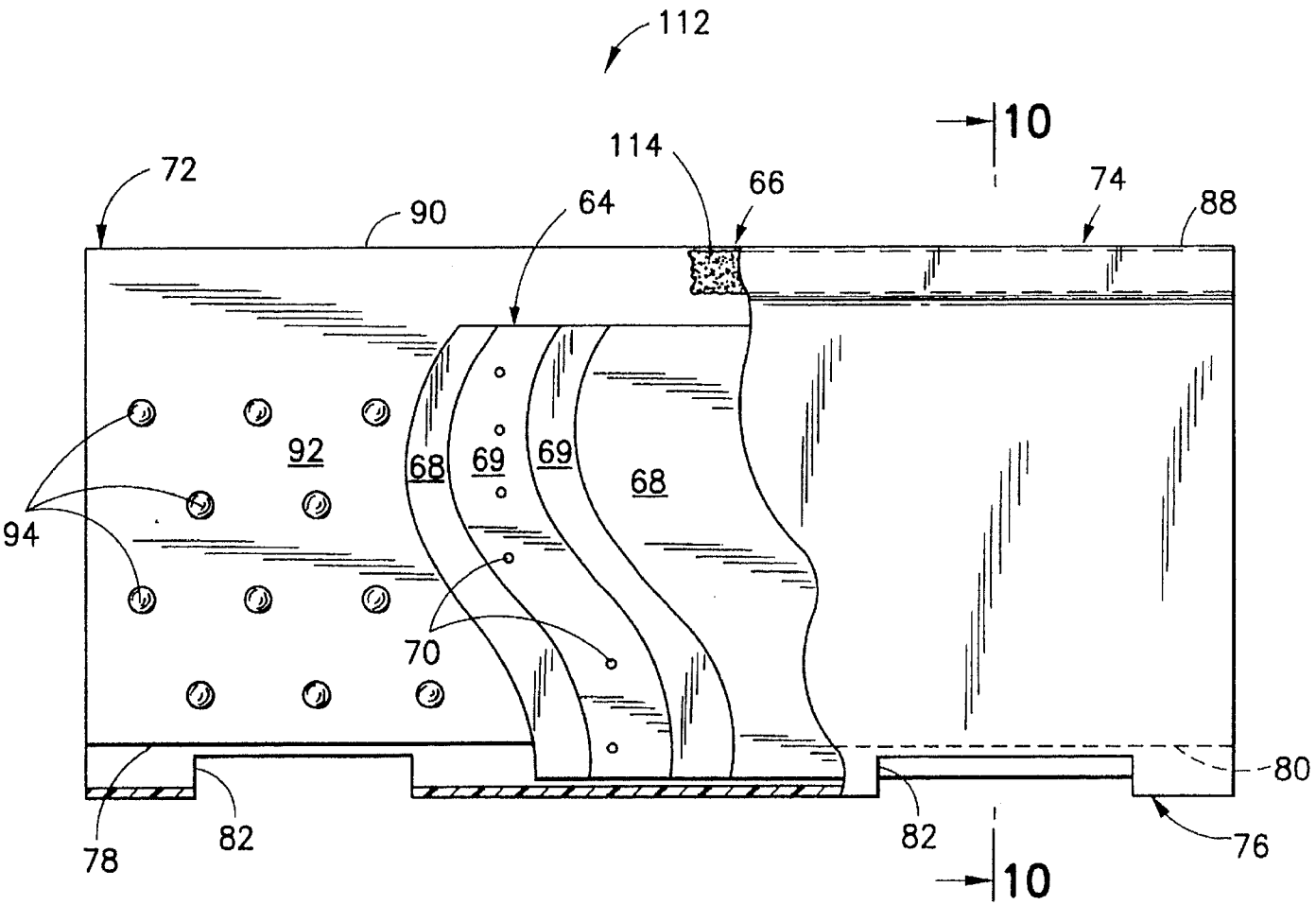
FIG. 9 is a rear elevation view, partially cut away, of still another horn switch assembly according to the present invention.

Referring to FIGS. 9 and 10, an additional horn switch assembly 112 according to the present invention is shown. The horn switch assembly 112 is similar to the horn switch assembly 62 of FIGS. 3 and 4. In place of the two tabs 84 and two tab receptors 86 of the horn switch assembly 62 of FIGS. 3 and 4, a weld 114 secures the rear inner surface 92 of the jacket front cover 72 adjacent the second edge 90 of the jacket front cover to the front inner surface 96 of the jacket back cover 74 adjacent the second edge 88 of the jacket back cover. The horn switch assembly 10 of FIGS. 1 and 2 could also alternatively have the jacket front cover secured to the jacket back cover with a weld in place of the tabs and tab receptors.

Since other requirements and environments varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

We claim:

1. A horn switch jacket for use with a horn switch as part of a horn switch assembly for inserting into a horn switch pocket adjacent an airbag module cover, the horn switch jacket comprising:

a jacket front cover having a rear inner surface adapted to be positioned in front of the horn switch;

a jacket back cover adapted to be positioned behind the horn switch;

a hinge portion connecting a first edge of the jacket front cover to a first edge of the jacket back cover; and securing means for securing the jacket back cover to the jacket front cover with the horn switch held therebetween.

2. The horn switch jacket of claim 1 further comprising:

a plurality of spaced-apart force concentrators extending rearwardly from the rear inner surface of the jacket front cover.

3. The horn switch jacket of claim 2 further comprising:

a plurality of spaced-apart supports extending forwardly from a front inner surface of the jacket back cover.

4. The horn switch jacket of claim 3 for use with a horn switch comprising a bend sensor horn switch having a plurality of spaced-apart resistive elements, wherein:

the plurality of spaced-apart force concentrators extending rearwardly from the rear inner surface of the jacket front cover are arranged so that each resistive element of the bend sensor horn switch will be positioned behind a force concentrator when the rear inner surface is positioned in front of the bend sensor horn switch; and the plurality of spaced-apart supports extending forwardly from the front inner surface of the jacket back cover are arranged so that each resistive element will be positioned between two adjacent supports when the front inner surface is positioned behind the bend sensor horn switch, whereby pressure applied to the jacket front cover will cause at least one force concentrator to bend a resistive element about two adjacent supports.

5. The horn switch jacket of claim 4 wherein the resistive elements are arranged in substantially parallel columns, and the plurality of force concentrators are in the form of parallel, spaced-apart, elongated force concentration ribs arranged so that the concentration ribs will be generally perpendicular to the columns of resistive elements with each resistive element positioned behind a force concentration rib when the rear inner surface is positioned in front of the bend sensor horn switch; and the plurality of supports are in the form of parallel spaced-apart elongated support ribs arranged so that the support ribs are generally parallel to and offset from the force concentration ribs and will be generally perpendicular to the columns of resistive elements with each resistive element positioned between two adjacent support ribs when the front inner surface is positioned behind the bend sensor horn switch, whereby pressure applied to the jacket front cover will cause at least one force concentration rib to bend at least one resistive element about two adjacent support ribs.

6. A horn switch assembly for mounting in a horn switch pocket adjacent an airbag module cover, the assembly comprising:

a horn switch jacket front cover having a rear inner surface;

a horn switch connectable to a horn control circuit and positioned behind the rear inner surface of the jacket front cover;

a horn switch jacket back cover positioned behind the horn switch; and securing means securing the jacket back cover to the jacket front cover with the horn switch held therebetween.

7. The horn switch assembly of claim 6 further comprising:

a hinge portion connecting a first edge of the jacket front cover to a first edge of the jacket back cover.

8. The horn switch assembly of claim 6 wherein the securing means comprises:

two tabs receptors extending from a second edge of the jacket front cover; and two tabs extending from a second edge of the jacket back cover and engaging the two tab receptors.

9. The horn switch assembly of claim 6 wherein the securing means comprises:

two holes extending through the jacket back cover; and two posts extending from the rear inner surface of the jacket front cover through the two holes in the jacket back cover and having heads extending over the jacket back cover adjacent the holes.

10. The horn switch assembly of claim 6 wherein the securing means comprises:

a second edge of the front cover opposite the first edge thereof forming a lip engaging a second edge of the back cover opposite the first edge thereof.

11. The horn switch assembly of claim 6 wherein the securing means comprises:

a weld between the jacket front cover and the jacket back cover.

12. The horn switch assembly of claim 6 further comprising:

a plurality of spaced-apart force concentrators extending rearwardly from the rear inner surface of the jacket front cover.

13. The horn switch assembly of claim 12 wherein:

the horn switch comprises a membrane horn switch.

14. The horn switch assembly of claim 12 further comprising:

a plurality of spaced-apart supports extending forwardly from a front inner surface of the jacket back cover.

15. The horn switch jacket of claim 14 wherein:

the horn switch comprises a bend sensor horn switch having a plurality of spaced-apart resistive elements:

the plurality of spaced-apart force concentrators extending rearwardly from the rear inner surface of the jacket front cover are arranged so that each resistive element of the bend sensor horn switch is positioned behind a force concentrator; and the plurality of spaced-apart supports extending forwardly from the front inner surface of the jacket back cover are arranged so that each resistive element is positioned between two adjacent supports, whereby pressure applied to the jacket front cover will cause at least one force concentrator to bend a resistive element about two adjacent supports.

16. The horn switch assembly of claim 15 wherein:

the resistive elements of the bend sensor horn switch are arranged in a plurality of parallel spaced-apart columns;

the plurality of force concentrators are in the form of parallel, spaced-apart, elongated force concentration ribs arranged so that the concentration ribs are generally perpendicular to the columns of resistive elements and each resistive element is positioned behind a force concentration rib; and the plurality of supports are in the form of parallel spaced-apart elongated support ribs arranged so that the support ribs are generally parallel to and offset from the force concentration ribs and are generally perpendicular to the columns of resistive elements with each resistive element positioned between two adjacent support ribs, whereby pressure applied to the jacket front cover will cause at least one force concentration rib to bend at least one resistive element about two adjacent support ribs.

17. The horn switch assembly of claim 16 further comprising:

alignment retainer means for retaining the bend sensor horn switch aligned with the jacket front cover and the jacket back cover so that each resistive element remains positioned behind a force concentration rib.

18. The horn switch assembly of claim 17 wherein the alignment retainer means comprises:

two bumpers extending rearwardly from the rear inner surface of the jacket front cover, with a first edge of the bend sensor horn switch butting against the hinge portion and a second edge of the bend sensor horn switch opposite the first edge of the bend sensor horn switch butting against the two bumpers.

* * * * *

UNITED STATES PATENT AND TRADEMARK OFFICE

CERTIFICATE OF CORRECTION

PATENT NO. : 5,639,998

DATED : 17 June 1997

INVENTOR(S) : Merle K. Ricks and Kevin W. Booth

It is certified that error appears in the above-indentified patent and that said Letters Patent is hereby corrected as shown below:

At title page, Inventors:, "Booth, Roy," should be --Booth, Riverdale,--.

At column 4, line 58, "horn switch 24." should be --horn switch 14.--.

Signed and Sealed this

Fourteenth Day of October, 1997

*Attest:*

*Attesting Officer*

Bruce Lehman

BRUCE LEHMAN

*Commissioner of Patents and Trademarks*